US010418174B2

(12) United States Patent
Mikogami et al.

(10) Patent No.: US 10,418,174 B2
(45) Date of Patent: Sep. 17, 2019

(54) COIL COMPONENT AND MANUFACTURING METHOD THEREOF

(71) Applicant: TDK Corporation, Tokyo (JP)

(72) Inventors: Tasuku Mikogami, Tokyo (JP); Nobuo Takagi, Tokyo (JP); Kouyu Ohi, Tokyo (JP); Syun Ashizawa, Tokyo (JP); Setu Tsuchida, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/200,383

(22) Filed: Jul. 1, 2016

(65) Prior Publication Data

US 2017/0011843 A1 Jan. 12, 2017

(30) Foreign Application Priority Data

Jul. 6, 2015 (JP) ..... 2015-135491

(51) Int. Cl.

| | |
|---|---|
| ***H01F 41/06*** | (2016.01) |
| ***H01F 17/04*** | (2006.01) |
| ***H01F 41/069*** | (2016.01) |
| ***H01F 27/28*** | (2006.01) |
| ***H01F 27/29*** | (2006.01) |
| *H01F 27/26* | (2006.01) |

(52) U.S. Cl.

CPC ..... *H01F 41/069* (2016.01); *H01F 27/2828* (2013.01); *H01F 27/292* (2013.01); *H01F 17/045* (2013.01); *H01F 27/263* (2013.01)

(58) Field of Classification Search

CPC ..... H01F 17/045; H01F 41/069

See application file for complete search history.

(56) References Cited

U.S. PATENT DOCUMENTS 3,593,217 A * 7/1971 Weber ..... H01F 17/045 333/175
4,314,221 A * 2/1982 Satou ..... H01F 27/29 336/192

(Continued)

FOREIGN PATENT DOCUMENTS

JP 04216603 A * 8/1992
JP 1992216603 A 8/1992

(Continued)

OTHER PUBLICATIONS

JP2010010597A, Machine Translation, Jan. 2010.*

*Primary Examiner* — Elvin G Enad
*Assistant Examiner* — Malcolm Barnes
(74) *Attorney, Agent, or Firm* — Young Law Firm, P.C.

(57) ABSTRACT

Disclosed herein is a coil component that includes a drum core including a pair of flange portions and a winding core portion positioned between the flange portions, a plurality of terminal electrodes formed on the flange portions, and a plurality of wires wound around the winding core portion, each end of the wires being electrically connected to an associated one of the terminal electrodes. Each of the flange portions has an inner side surface connected to the winding core portion and an outer side surface opposite to the inner side surface, the outer side surface has a plurality of ridges and at least one groove, and the terminal electrodes are formed on at least the ridges of the outer side surfaces such that the terminal electrodes are isolated from each other by the groove.

16 Claims, 8 Drawing Sheets

(56) References Cited

U.S. PATENT DOCUMENTS 5,457,872 A * 10/1995 Sakata ..... H01F 27/292 29/605
6,100,782 A * 8/2000 Kitagawa ..... H01F 5/04 336/192
6,344,784 B1 * 2/2002 Murata ..... H01F 17/0033 336/192
2001/0022547 A1 * 9/2001 Murata ..... H01F 17/0033 336/83
2003/0071704 A1 * 4/2003 Toi ..... H01F 17/045 336/83
2004/0021541 A1 * 2/2004 Otsuka ..... H01F 17/045 336/175
2004/0108928 A1 * 6/2004 Chou ..... H01F 17/045 336/83
2006/0267719 A1 * 11/2006 Yasuda ..... H01F 17/045 336/223
2008/0003864 A1 * 1/2008 Hatakeyama ..... H01F 17/045 439/399
2012/0133469 A1 * 5/2012 Tomonari ..... H01F 3/14 336/192
2013/0049914 A1 * 2/2013 Huang ..... H01F 27/292 336/192
2013/0186995 A1 * 7/2013 Yamaguchi ..... H01F 5/02 242/432.6
2013/0229254 A1 * 9/2013 Lee ..... H01F 27/263 336/220
2014/0292463 A1 * 10/2014 Lai ..... H01F 27/29 336/192
2016/0240305 A1 * 8/2016 Igarashi ..... H01F 27/2823

FOREIGN PATENT DOCUMENTS

JP 09-219333 A 8/1997
JP 2010010597 A * 1/2010 ..... H01F 17/04
JP 2010010597 A * 1/2010 ..... H01F 17/04
JP 2013191694 A * 9/2013 ..... H01F 27/29
JP 2014-199906 10/2014

* cited by examiner

COIL COMPONENT AND MANUFACTURING METHOD THEREOF

BACKGROUND OF THE INVENTION

Field of the Invention

The present invention relates to a coil component and a manufacturing method of the coil component, and particularly to a coil component that uses a drum core and a manufacturing method thereof.

Description of Related Art

In recent years, electronic components that are used in information terminal devices such as smartphones have been strongly required to be smaller in size and lower in height. Therefore, as for coil components such as pulse transformers, surface-mount coil components that use drum cores instead of toroidal cores have been frequently used. For example, Japanese Patent Application Laid-Open No. 2012-119568 discloses a step-up transformer of a surface-mount type that uses a drum core.

The drum core of the pulse transformer disclosed in Japanese Patent Application Laid-Open No. 2014-199906 includes a flange portion having amount surface and an outer side. As shown in FIG. 2 of Japanese Patent Application Laid-Open No. 2014-199906, the mount surface of the flange portion has grooves and ridges at its mount surface. Wires are connected, at one end, to the ridges. The outer side of the flange portion is flat, and no terminal electrodes are formed on the outer side. When the pulse transformer disclosed in Japanese Patent Application Laid-Open No. 2014-199906 is mounted on a printed circuit board, solder will fill the gap between the lands formed on the printed circuit board and the ridges of the flange portion. By contrast, no solder fillets will be formed outside the flange, because no terminal electrodes are formed on the outer side of the flange portion.

In recent years, it is desired that coil components for use in vehicles, in particular, should have higher reliability than before. To meet this demand, it would important to form solder fillets when the coil component is mounted. In order to form solder fillets, terminal electrodes must be formed on the outer side of the flange portion. However, the step of forming the terminal electrodes will be complicated if the outer side of the flange portion is flat as in the drum core described in Japanese Patent Application Laid-Open No. 2014-199906.

SUMMARY

It is therefore an object of the present invention to provide a coil component in which terminal electrodes can be easily formed on outer side of each flange portion, and a method of manufacturing this coil component.

A coil component according to one aspect of the present invention includes: a drum core including a pair of flange portions and a winding core portion positioned between the flange portions; a plurality of terminal electrodes formed on the flange portions; and a plurality of wires wound around the winding core portion, each end of the wires being electrically connected to an associated one of the terminal electrodes. Each of the flange portions has an inner side surface connected to the winding core portion and an outer side surface opposite to the inner side surface. The outer side surface has a plurality of ridges and at least one groove. The terminal electrodes are formed on at least the ridges of the outer side surfaces such that the terminal electrodes are isolated from each other by the groove.

According to this aspect of the present invention, because the outer side surface of each flange portion has ridges and groove and the terminal electrodes are formed on the ridges, the electrode terminals can be easily formed on the outer side of each flange portion. Hence, solder fillets can be easily formed when the coil component is mounted on a printed circuit board. This helps the coil component to have high reliability.

It is preferable that each of the flange portions further has amount surface that is parallel to an axis of the winding core portion, the mount surface has a plurality of ridges to which the ends of the wires are electrically connected and at least one groove positioned between the ridges, and the terminal electrodes are further formed on the ridges of the mount surfaces such that the terminal electrodes formed on the mount surfaces are isolated from each other by the groove formed on the mount surfaces. Thus, the terminal electrodes can also be easily formed on the mount surface of each flange portion.

In this case, it is preferable that each of the flange portions further has an adhesion surface opposite to the mount surface, and a plate-shaped core is adhered to the adhesion surfaces of the flange portions. According to this feature, the magnetic characteristics of the coil component can be improved.

In the present invention, each of the ridges of the outer side surfaces may extend from an edge of the mount surface to an edge of the mount surface, and each of the terminal electrodes may be formed on a part of the ridges of the outer side surfaces located close to the mount surface while each of the terminal electrodes is not formed on another part of the ridges of the outer side surfaces close to the adhesion surface. In this case, too, solder fillets are formed when the coil component is mounted.

In the present invention, at least a part of the ridges of the outer side surfaces may be greater in width than the ridges of on the mount surfaces. According to this feature, larger fillets can be formed than otherwise, thereby to improve the reliability of the coil component.

In the present invention, the ridges of the mount surface may include a first ridge and a second ridge, and the terminal electrodes formed on the first and second ridges may be electrically short-circuited via one of the terminal electrodes formed on the ridges of the outer side surfaces. According to this feature, the two terminal electrodes can be electrically short-circuited, and the fillets can be formed larger than otherwise.

In the present invention, the wires include first, second, third and fourth wires, the terminal electrodes include first, second, third and fourth terminal electrodes formed on one of the flange portions and fifth, sixth, seventh and eighth terminal electrodes formed on the other flange portion, each one end of the first, second, third and fourth wires is electrically connected to different one of the first, second, third and fourth terminal electrodes, and each other end of the first, second, third and fourth wires is electrically connected to different one of the fifth, sixth, seventh and eighth terminal electrodes. In this case, the coil component can be used as a pulse transformer.

In a method of manufacturing a coil component according to another aspect of the present invention, the method includes: preparing a drum core including a pair of flange portions and a winding core portion positioned between the flange portions; forming a plurality of terminal electrodes on the flange portions; and winding a plurality of wires around the winding core portion and electrically connecting each end of the wires to an associated one of the terminal electrodes. Each of the flange portions has an inner side surface connected to the winding core portion and an outer side surface opposite to the inner side surface. The outer side surface has a plurality of ridges and at least one groove. The forming is performed by preparing electrode material in a form of liquid and immersing the ridges of the outer side surface in the electrode material while preventing the electrode material from contacting to a bottom of the groove.

According this aspect of the present invention, the terminal electrodes can be easily formed on the outer side surface of each of the flange portions.

It is preferable that each of the flange portions further has amount surface that is parallel to an axis of the winding core portion, the mount surface has a plurality of ridges and at least one groove, and the winding includes connecting ends of the wires to the ridges of the mount surface. In this case, it is preferable that the forming is performed by immersing the ridges of the mount surfaces in the electrode material while preventing the electrode material from contacting to a bottom of the groove of the mount surfaces. According to this feature, terminal electrodes can be easily formed, also on the mount surface of each of the flange portions.

This invention can provide a coil component having flange portions and terminal electrodes, and also a method of manufacturing the coil component. In the method, the terminal electrodes can be easily formed on the outer side surface of each flange portion. Therefore, when the coil component is mounted on a printed circuit board, solder fillets are formed on the outer side surface of each flange portion. Hence, the coil component can have high reliability.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
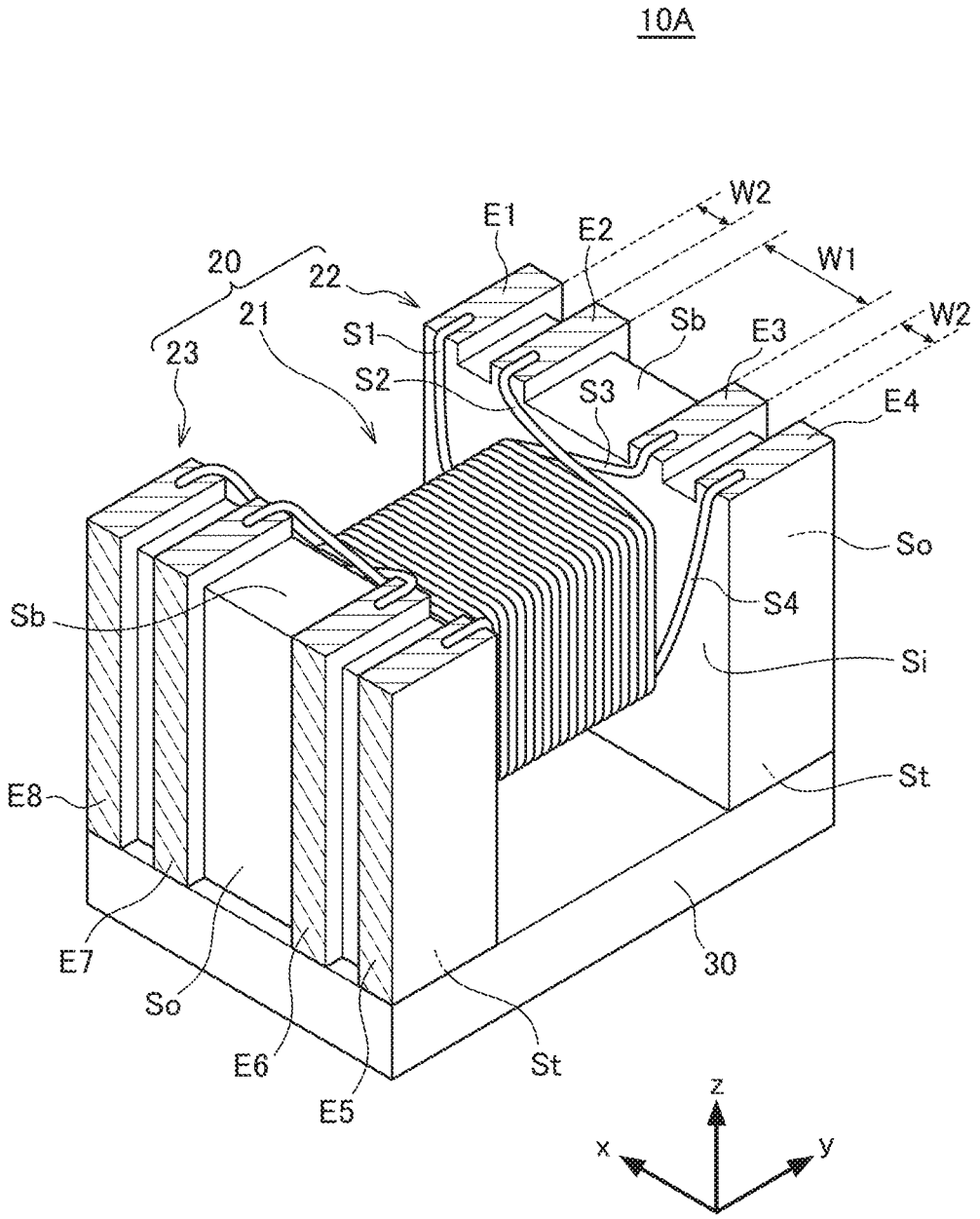
FIG. 1 is a schematic perspective view showing an appearance of a coil component according to a first embodiment of the present invention.

FIG. 1 is a schematic perspective view showing an appearance of a coil component 10A according to the first embodiment of the present invention.

The coil component 10A of the present embodiment is a pulse transformer of a surface-mount type. As shown in FIG. 1, the coil component 10 includes a drum core 20, a plate core 30 that is bonded to the drum core 20, and conductive wires S1 to S4 that are wound around a winding core portion 21 of the drum core 20. The coil component of the present invention is not limited to the pulse transformer. The coil component of the present invention may be any other transformer component such as a balun transformer or step-up transformer, or may be a filter component such as a common mode choke coil.

The drum core 20 and the plate core 30 are made of a magnetic material that is relatively high in magnetic permeability such as a sintered composite of Ni—Zn ferrite or Mn—Zn ferrite, for example. Incidentally, the magnetic material that is high in magnetic permeability such as Mn—Zn ferrite is usually low in specific resistance and electrically conductive.

The drum core 20 includes a rod-shaped winding core portion 21 and first and second flange portions 22 and 23 which are provided on opposite ends of the rod-shaped winding core portion 21, respectively. The winding core portion 21, the first flange portion 22, and the second flange portion 23 are integrated, forming one structure. Each of the flange portions 22 and 23 has an inner side surface Si connected to the winding core portion 21, an outer side surface So opposite to the inner side surface Si, an mount surface Sb parallel to the axis of the winding core portion 21, and an adhesion surface St opposite to the mount surface Sb. Each of the inner side surface Si and the outer side surface So have an xz plane, and each of the mount surface Sb and the adhesion surface St have an xy plane.

The coil component 10A is a component to be mounted on a printed circuit board in an actual use. Once the coil component 10A has been mounted on the printed circuit board, the mount surfaces Sb of the flange portions 22 and 23 face to the printed circuit board. The plate-shaped core 30 is secured, with adhesive, to the adhesion surfaces St of the flange portions 22 and 23. Thus, the drum core 20 and the plate-shaped core 30 constitute a closed magnetic path.

As shown in FIG. 1, the outer side surface So and mount surfaces Sb of the flange portions 22 and 23 have ridges and grooves. More specifically, in this embodiment, both the outer side surface So and the mount surface Sb have four ridges and three grooves. The two ridges adjacent in the x direction are isolated by a respective groove on the outer side surface So and mount surface Sb. The four ridges formed on the outer side surface So are aligned with the four ridges formed on the mount surface Sb, respectively, in the x direction. On the outer side surface So and the mount surfaces Sb, terminal electrodes are formed on the ridges. Thus, four terminal electrodes are formed on both the flange portion 22 and the flange portion 23.

More precisely, four L-shaped terminal electrodes E1 to E4 are provided on the first flange portion 22, and likewise, four L-shaped terminal electrodes E5 to E8 are provided on the second flange portion 23. The terminal electrodes E1 to E8 are made of conductive material coated on the flange portions 22 and 23. No conductive material is coated in the grooves. Hence, the terminal electrodes provided on one same flange portion (e.g., electrodes E1 to E4) are electrically isolated by the grooves that have no conductive material.

As shown in FIG. 1, the four wires S1 to S4 are wound around the winding core portion 21. The wires S1 to S4 are connected, at one end, to the terminal electrodes E1 to E4, respectively. The wires S1 to S4 are connected, at the other end, to the terminal electrodes E5 to E8, respectively. The wires S1 to S4 are connected at the ridges on the mount surfaces Sb. The method of connecting the wires is not limited to a particular one. Nonetheless, the wires may be connected by thermocompression bonding or using a laser.

The wire S1 is connected between, for example, the terminal element E1 and the terminal element E8, and is wound in, for example, clockwise direction. The wire 2 is connected between the terminal element E2 and the terminal element E7, and is wound in, for example, counterclockwise direction. The wire 3 is connected between the terminal element E3 and the terminal element E6, and is wound in, for example, clockwise direction. The wire 4 is connected between the terminal element E4 and the terminal element E5, and is wound in, for example, counterclockwise direction.

In this embodiment, the distance between the terminal electrodes E2 and E3 and the distance between the terminal electrodes E6 and E7 are designed so as to be wide. If the distance between the terminal electrodes E2 and E3 (or the distance between the terminal electrodes E6 and E7) is defined as W1, and the distance between adjacent other terminal electrodes such as E1 and E2 is defined as W2, the following formula is satisfied.

$$W1>W2.$$

Hence, the dielectric breakdown voltage between the primary and secondary windings can be increased if the terminal electrodes E1 and E2 are used as primary-side input/output terminals, the terminal electrodes E5 and E6 are used as secondary-side input/output terminals, the terminal electrodes E7 and E8 are used as primary-side center tap and the terminal electrodes E3 and E4 are used as secondary-side center tap. In this case, the terminal electrodes E7 and E8 constituting the primary-side center tap may be short-circuited on the printed circuit board, and the terminal electrodes E3 and E4 constituting the secondary-side center tap may be short-circuited on the printed circuit board.

The flange portions 22 and 23 do not have ridges or grooves at the other surfaces. Particularly, the adhesion surface St is almost flat, and well contacts the plate-shaped core 30 that is flat.

A method of forming the terminal electrodes E1 to E8 on the drum core 20 will be explained.

Figure 2:
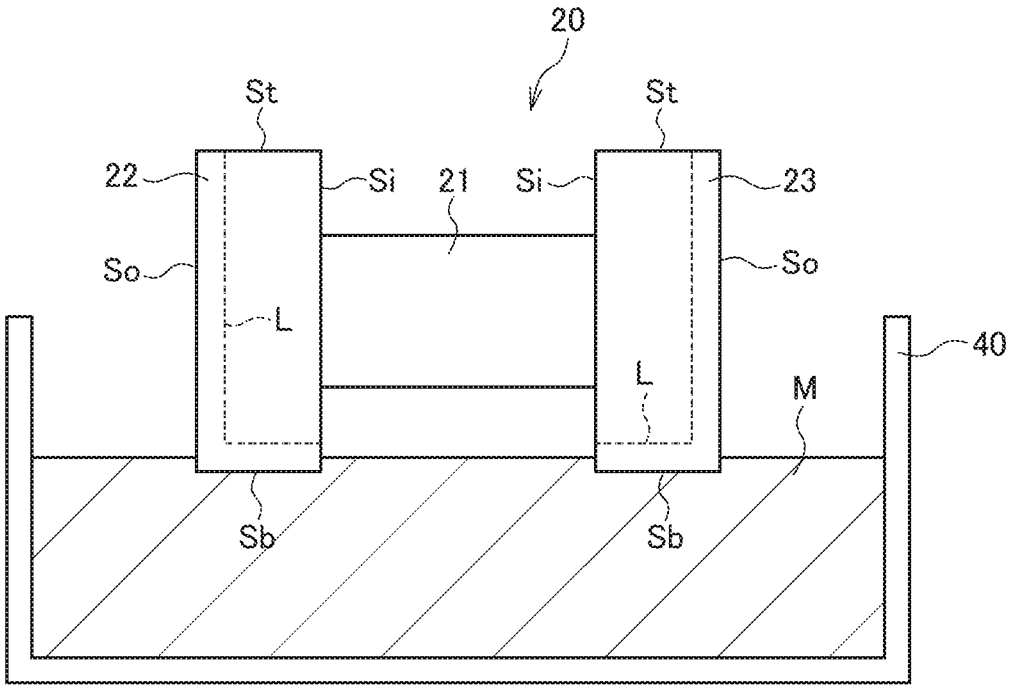
FIG. 2 a schematic diagram for explaining how to form a terminal electrode on amount surface of the flange portions.
Figure 3:
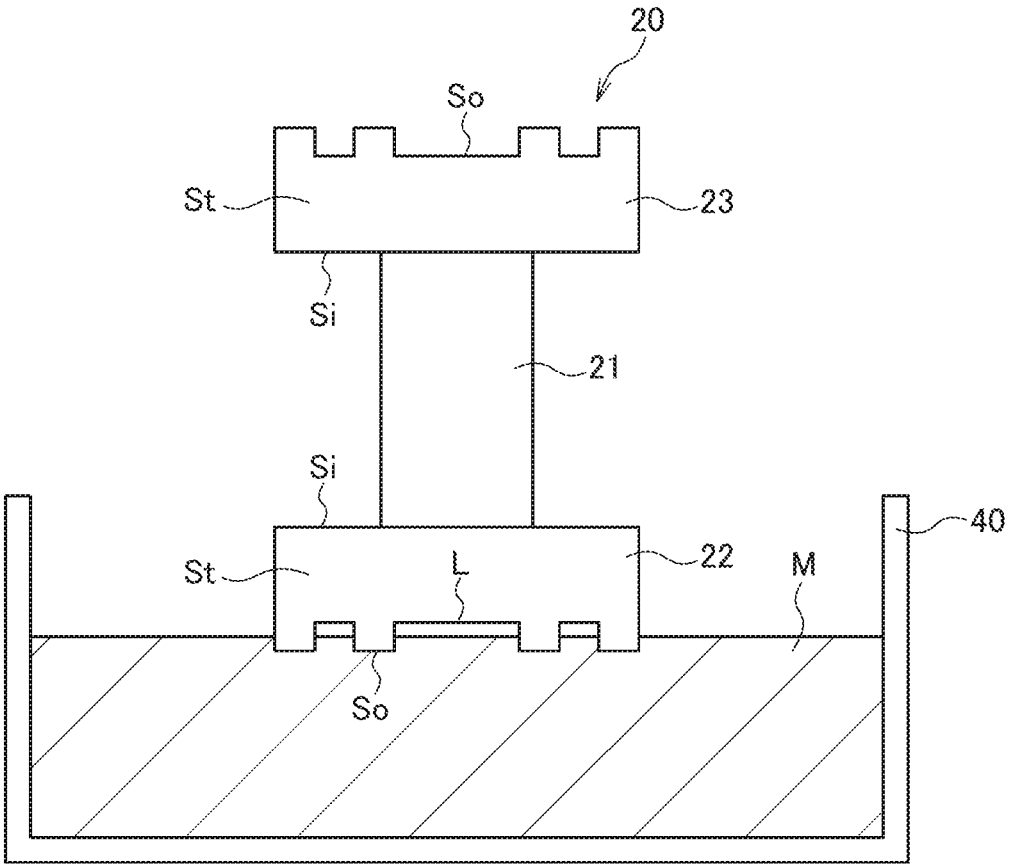
FIG. 3 a schematic diagram for explaining how to form a terminal electrode on an outer surface of the flange portions.

First, the drum core 20 shaped as shown in FIG. 1 is prepared, and electrode material M is prepared in the form of liquid. Then, as shown in FIG. 2, the electrode material M is poured into a vessel 40 open at the top. Thereafter, the ridges formed on the mount surfaces Sb of the flange portions 22 and 23 are immersed into the electrode material M so as to form the terminal electrodes on the mount surfaces Sb. At this point, the depth to which the flange portions 22 and 23 are immersed is controlled, preventing the electrode material M from flowing into the grooves cut in the mount surfaces Sb. That is, the immersion depth is controlled, setting the surface of the electrode material M at a level between any ridge and any groove. In FIG. 2 and FIG. 3, "L" indicates the bottom of the groove. The eight terminal electrodes E1 to E8 can be formed on the mount surfaces Sb of the flange portions 22 and 23, at the same time in a one immersing step.

Next, as shown in FIG. 3, the ridges on the outer side surface So of the flange portion 22 are immersed in the electrode material M, thereby forming terminal electrodes on the outer side surface So of the flange portion 22. At this point, too, the depth to which the flange portion 22 is immersed is controlled, preventing the electrode material M from contacting the grooves cut in the outer side surface So. Therefore, in one immersing step, four terminal electrodes E1 to E4 can be formed on the outer side surface So of the flange portion 22 at the same time. Similarly, four terminal electrodes E5 to E8 can be formed on outer side surface So of the flange portion 23 at the same time.

Thus, the terminal electrodes E1 to E8 can be formed on the drum core 20 by repeating the immersing step three times. That is, the terminal electrodes E1 to E8 can be formed very easily by a dipping method, without using screen printing or mask sputtering.

After the terminal electrodes E1 to E8 have been so formed, the wires S1 to S4 are wound around the winding core portion 21, and the wires S1 to S4 are connected, at one end, to the terminal electrodes E1 to E8, respectively. The coil component 10A according to this embodiment is thereby produced.

In the coil component 10A according to this embodiment, the outer side surface So and mount surface Sb of the drum core 20 have grooves and ridges. Therefore, the terminal electrodes E1 to E8 can be formed easily by the dipping method. In addition, since the terminal electrodes E1 to E8 are formed also on the outer side surface So, solder fillets will be formed when the coil component 10A is mounted on the printed circuit board. The solder fillets so formed enhance the mounting strength. The coil component 10A therefore has high reliability demanded of any component for use in vehicles, for example.

Figure 4:
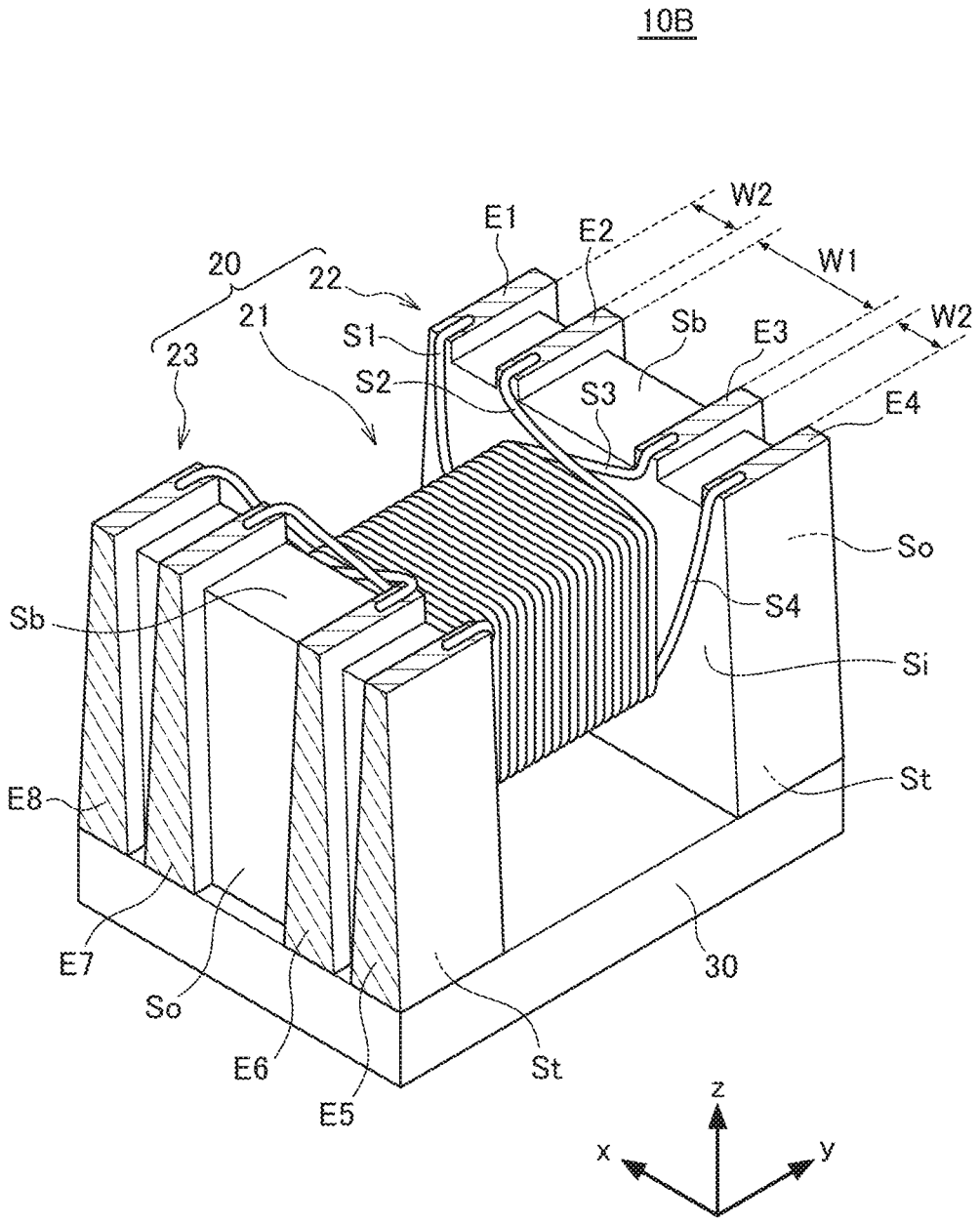
FIG. 4 is a schematic perspective view showing an appearance of a coil component according to a second embodiment of the present invention.

FIG. 4 is a schematic perspective view showing an appearance of a coil component 10B according to the second embodiment of the present invention.

The coil component 10B according to the second embodiment differs from the coil component 10A according to the first embodiment, in that the width in x direction of the ridges formed on the outer side surface So gradually increases, from the mount surface Sb toward the adhesion surface St. The width in x direction of the terminal electrodes E1 to E8 provided on the outer side surface So also gradually increases, from the mount surface Sb toward the adhesion surface St. As a result, the terminal electrodes E1 to E8 provided on the outer side surface So are broader than the terminal electrodes E1 to E8 provided on the mount surface Sb. In any other structural respect, the coil component 10B is identical to the coil component 10A according to the first embodiment. The parts identical to those of the coil component 10A are specified by the same reference numerals, and will not be described repeatedly.

In the coil component 10B according to the second embodiment, the width of the terminal electrodes E1 to E8 provided on the outer side surface So gradually increases. Larger fillets can therefore be formed when the coil component 10B is mounted on the printed circuit board. The coil component 10B can therefore acquire a larger mounting strength than the coil component 10A. The mounting strength may be enhanced by the method shown in FIG. 4, by expanding one part of the terminal electrodes E1 to E8, or by increasing the width of some of the terminal electrodes E1 to E8.

Figure 5:
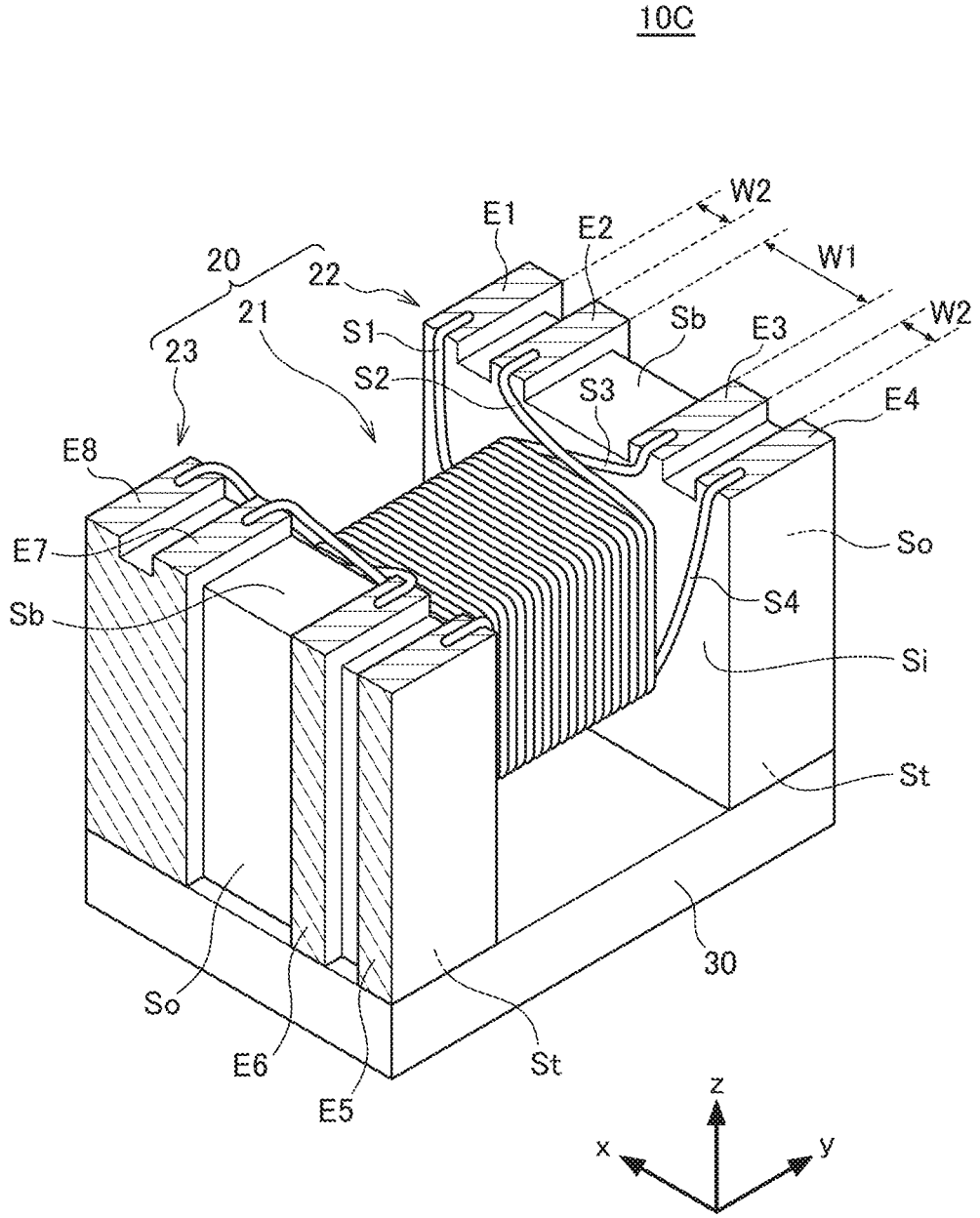
FIG. 5 is a schematic perspective view showing an appearance of a coil component according to a third embodiment of the present invention.

FIG. 5 is a schematic perspective view showing an appearance of a coil component 10C according to the third embodiment of the present invention.

In the coil component 10C according to the third embodiment, the terminal electrodes E3 and E4 provided on the outer side surface So are integrated into one terminal electrode, and the terminal electrodes E7 and E8 are integrated into one terminal electrode. Hence, on the outer side surface So, the ridges associated with the terminal electrodes E3 and E4 are integrated into one ridge, and the ridges associated with the terminal electrodes E3 and E4 are integrated into one ridge. In any other structural respect, the coil component 10C is identical to the coil component 10A according to the first embodiment. The parts identical to those of the coil component 10A are specified by the same reference numerals, and will not be described repeatedly.

In the coil component 10C according to the third embodiment, on each outer side surface So, some of the terminal electrodes are integrated. Since the integrated terminal electrode is very broad in the x direction, the mounting strength of the coil component 10C can be further increased. In the coil component 10C, the terminal electrodes E3 and E4 are electrically short-circuited, and the terminal electrodes E7 and E8 are electrically short-circuited. Therefore, the terminal electrodes E3 and E4 may be used as primary-side center tap, and the terminal electrodes E7 and E8 may be used as secondary-side center tap.

Figure 6:
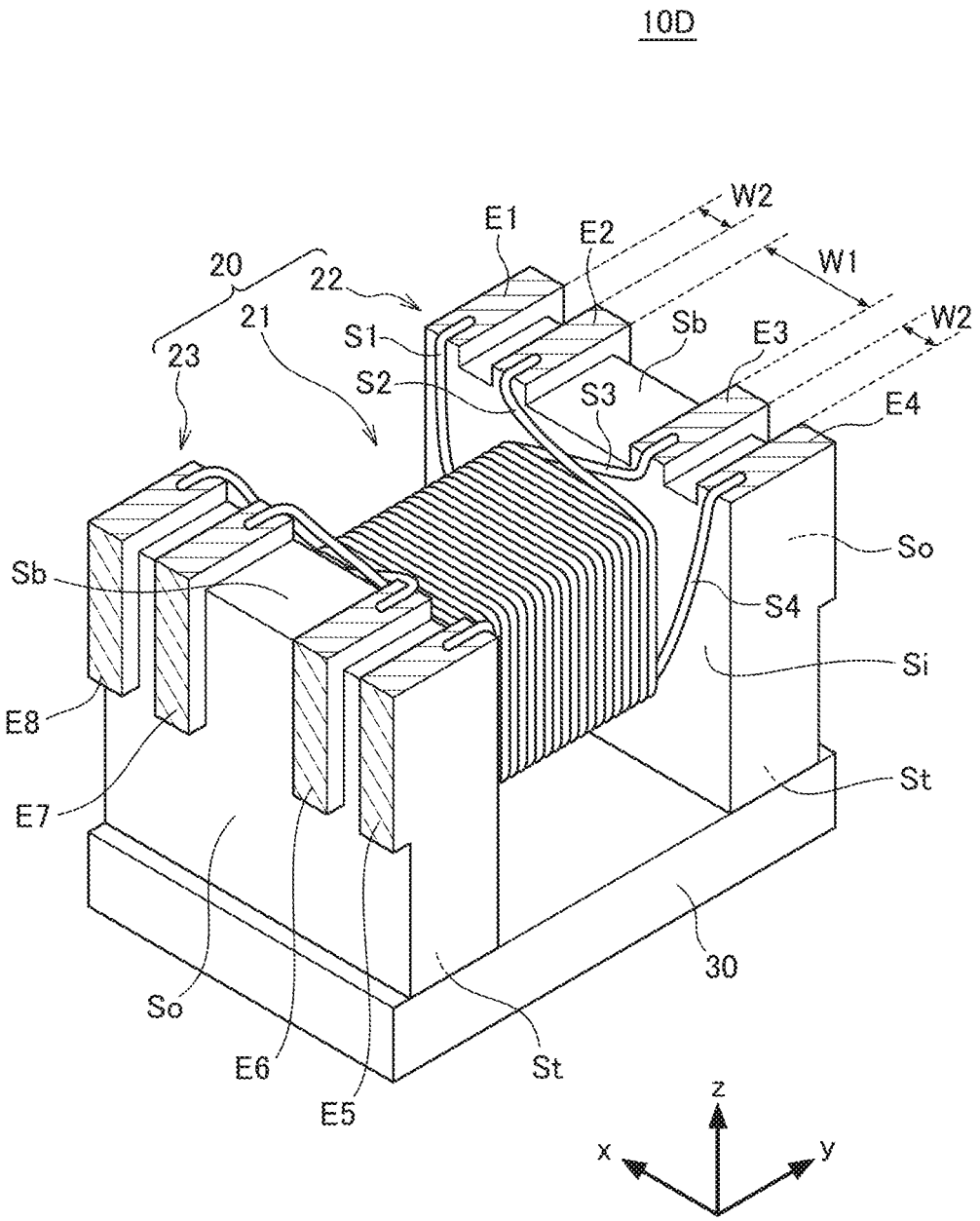
FIG. 6 is a schematic perspective view showing an appearance of a coil component according to a fourth embodiment of the present invention.

FIG. 6 is a schematic perspective view showing an appearance of a coil component 10D according to the fourth embodiment of the present invention.

In the coil component 10D according to the fourth embodiment, the ridges provided on the outer side surface So do not extend to the adhesion surface St, each terminating at the middle part of the outer side surface So. Like the ridges, the terminal electrodes E1 to E8 do not extend to the adhesion surface St, either, each terminating at the middle part of the outer side surface So. In any other structural respect, the coil component 10D is identical to the coil component 10A according to the first embodiment. The parts identical to those of the coil component 10D are specified by the same reference numerals, and will not be described repeatedly.

In the coil component 10D according to the fourth embodiment, the ridges on the outer side surface So need not extend to the adhesion surface St. They may be terminated near the position where fillets will be formed.

Figure 7:
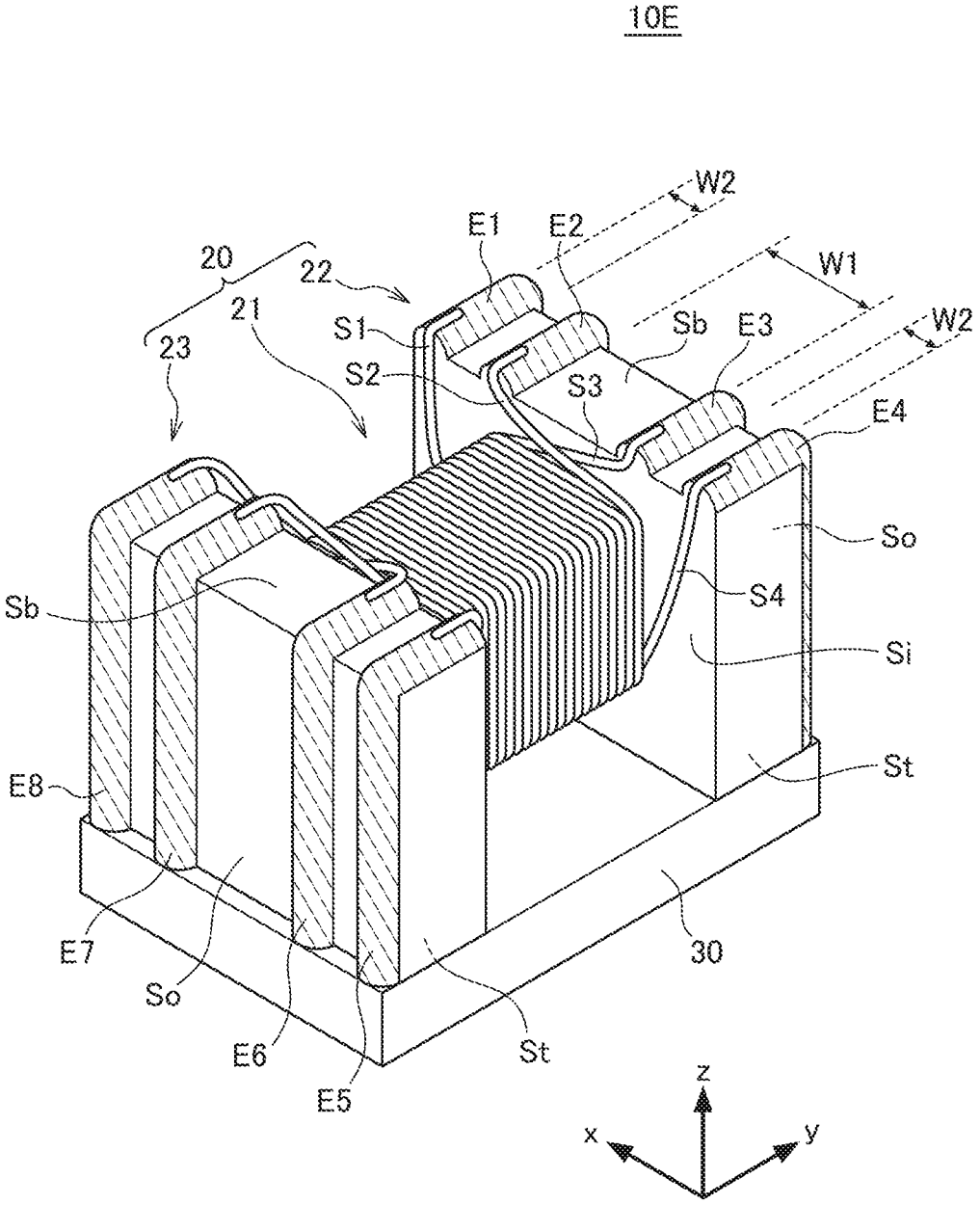
FIG. 7 is a schematic perspective view showing an appearance of a coil component according to a fifth embodiment of the present invention.

FIG. 7 is a schematic perspective view showing an appearance of a coil component 10E according to the fifth embodiment of the present invention.

In the coil component 10E according to the fifth embodiment, the ridges do not have a flat surface, but are chamfered or have a curved cross section. In any other structural respect, the coil component 10E is identical to the coil component 10A according to the first embodiment. The parts identical to those of the coil component 10E are specified by the same reference numerals, and will not be described repeatedly.

In fifth embodiment, bubbles hardly stay between the electrode material M in the form of a liquid and the surface of each ridge when the terminal electrodes E1 to E8 are formed by the dipping method. The terminal electrodes E1 to E8 can therefore be well coated with the electrode material M.

Figure 8:
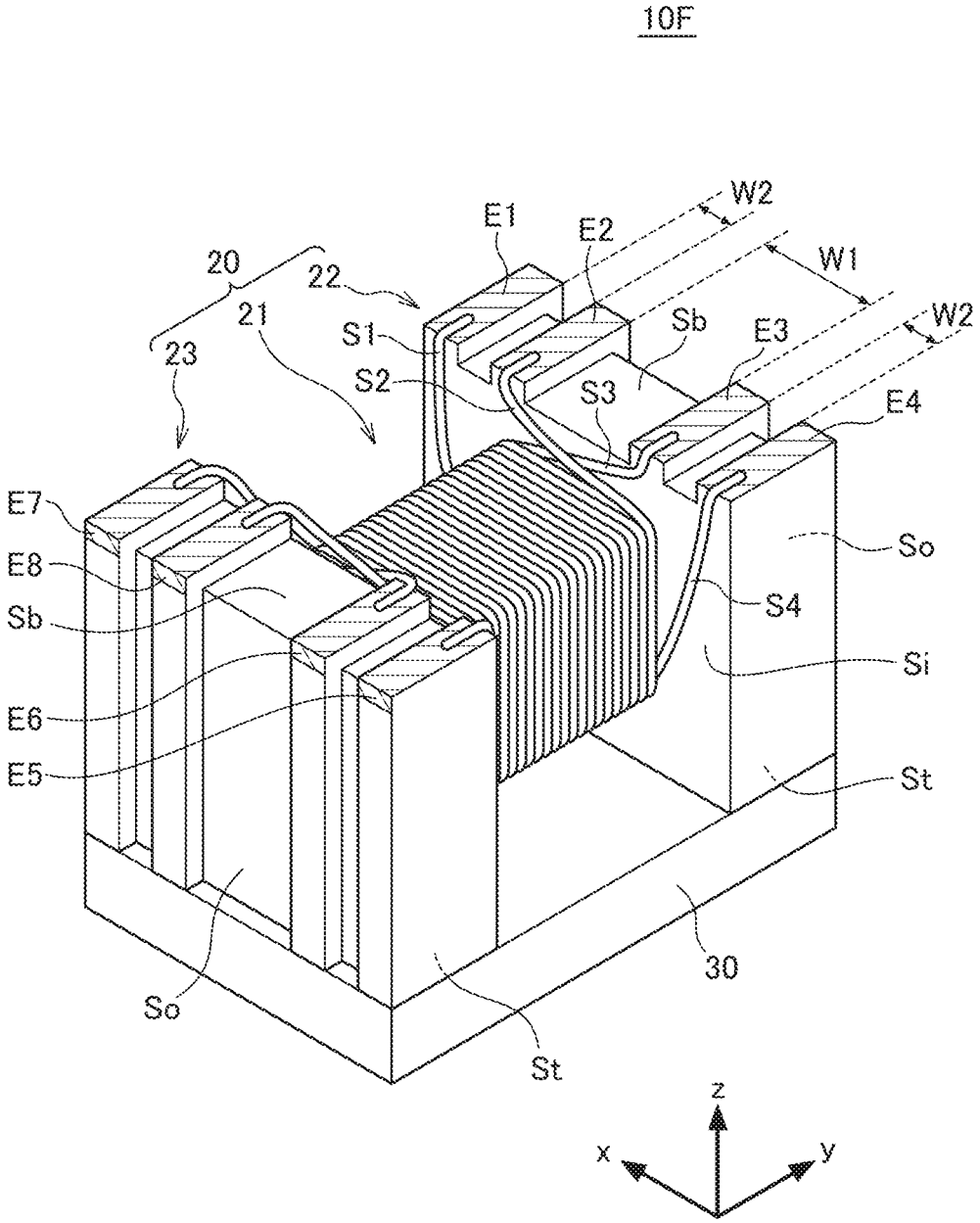
FIG. 8 is a schematic perspective view showing an appearance of a coil component according to a sixth embodiment of the present invention.

FIG. 8 is a schematic perspective view showing an appearance of a coil component 10F according to the sixth embodiment of the present invention.

In the coil component 10F according to the sixth embodiment, the electrode terminals E1 to E8 are not formed on the entire ridges provided on the outer side surface So. Rather, the electrode terminals E1 to E8 are formed on only those parts of the ridges, which are close to the mount surface Sb. In any other structural respect, the coil component 10F is identical to the coil component 10A according to the first embodiment. In other words, the coil component 10F differs from the coil component 10A according to the first embodiment, in that the electrode terminals E1 to E8 are removed from those parts of the ridges formed on the outer side surface So, which are close to the adhesion surface St.

Also in the sixth embodiment, the electrode terminals E1 to E8 are formed on those parts of the ridges, which are close to the mount surface Sb. Solder fillets can therefore be formed on the outer side surface So. In producing the coil component 10F according to the sixth embodiment, the terminal electrodes E1 to E8 can be formed on the outer side surface So, in the dipping method, while inclining the outer side surface So to the surface of the electrode material M in the form of a liquid.

It is apparent that the present invention is not limited to the above embodiments, but may be modified and changed without departing from the scope and spirit of the invention.

What is claimed is:

1. A coil component comprising:

a drum core including a pair of flange portions and a winding core portion positioned between the flange portions, each of the flange portions having a first adhesion surface substantially parallel with an axis of the winding core portion;

a plate-shaped core having a second adhesion surface adhered to the first adhesion surfaces of the flange portions;

a plurality of terminal electrodes formed on the flange portions; and a plurality of wires wound around the winding core portion, each end of the wires being electrically connected to an associated one of the terminal electrodes, wherein each of the flange portions further has an inner side surface connected to the winding core portion and an outer side surface opposite to the inner side surface, the outer side surface of each of the flange portions has a plurality of ridges and at least one groove, the plurality of ridges are arranged in a width direction of flange portions, the plurality of ridges include a first ridge positioned at one end of the outer side surface in the width direction and a second ridge positioned at other end of the outer side surface in the width direction, edges of the first and second ridges constitute edges of the flange portions in the width direction, the terminal electrodes are directly formed on at least the ridges of the outer side surfaces of each of the flange portions without an intervention of an insulating material such that the terminal electrodes are isolated from each other by the groove, and the second adhesion surface of the plate-shaped core has an area overlapping with the groove, the area being exposed without being covered with the first adhesion surfaces of the flange portions.

2. The coil component as claimed in claim 1, wherein each of the flange portions further has a mount surface that is parallel to the axis of the winding core portion and opposite to the first adhesion surface, the mount surface has a plurality of ridges to which the ends of the wires are electrically connected and at least one groove positioned between the ridges, and the terminal electrodes are further formed on the ridges of the mount surfaces such that the terminal electrodes formed on the mount surfaces are isolated from each other by the groove formed on the mount surfaces.

3. The coil component as claimed in claim 1, wherein
each of the ridges of the outer side surfaces extends from an edge of the mount surface to an edge of the adhesion surface, and
each of the terminal electrodes is formed on a part of the ridges of the outer side surfaces located close to the mount surface while each of the terminal electrodes is not formed on another part of the ridges of the outer side surfaces close to the adhesion surface.

4. The coil component as claimed in claim 2, wherein at least a part of the ridges of the outer side surfaces is greater in width than the ridges of on the mount surfaces.

5. The coil component as claimed in claim 2, wherein
the ridges of the mount surface include a first ridge and a second ridge, and
the terminal electrodes formed on the first and second ridges are electrically short-circuited via one of the terminal electrodes formed on the ridges of the outer side surfaces.

6. The coil component as claimed in claim 1, wherein
the wires include first, second, third and fourth wires,
the terminal electrodes include first, second, third and fourth terminal electrodes formed on one of the flange portions and fifth, sixth, seventh and eighth terminal electrodes formed on the other flange portion,
each one end of the first, second, third and fourth wires is electrically connected to different one of the first, second, third and fourth terminal electrodes, and
each other end of the first, second, third and fourth wires is electrically connected to different one of the fifth, sixth, seventh and eighth terminal electrodes.

7. The coil component as claimed in claim 1, wherein a width of each of the terminal electrodes is substantially a same as a width of an associated one of the ridges.

8. A coil component comprising:
a winding core;
a flange;
a plate-shaped core having an adhesion surface;
first and second terminal electrodes formed on the flange; and
first and second wires wound around the winding core, wherein
the flange includes a first surface, a second surface, and a third surface,
the first surface includes a first ridge, a second ridge, and a first groove located between the first and second ridges,
the second surface includes a third ridge, a fourth ridge, and a second groove located between the third and fourth ridges,
the first terminal electrode extends over the first and third ridges without an intervention of an insulating material between the flange and the second terminal electrode,
the second terminal electrode extends over the second and fourth ridges without an intervention of an insulating material between the flange and the first terminal electrode,
the first wire is connected to the first terminal electrode on the first ridge,
the second wire is connected to the second terminal electrode on the second ridge,
the third and fourth ridges are arranged in a first direction,
an edge of the third ridge forms an edge of the second surface in the first direction,
the adhesion surface of the plate-shaped core is adhered to the third surface of the flange, and
the adhesion surface of the plate-shaped core has a first area overlapping with the second groove, the first area being exposed without being covered with the third surface of the flange.

9. The coil component as claimed claim 8, wherein the first and second grooves are free from a conductive material at least on a bottom surface thereof.

10. The coil component as claimed claim 8, wherein the first and second surface are substantially perpendicular to each other.

11. The coil component as claimed claim 8 further comprising:
a third terminal electrode formed on the flange; and
a third wire wound around the winding core, wherein
the first surface further includes a fifth ridge and a third groove located between the second and fifth ridges,
the second surface further includes a sixth ridge and a fourth groove located between the fourth and sixth ridges,
the third terminal electrode extends over the fifth and sixth ridges,
the third wire is connected to the third terminal electrode on the fifth ridge, and
the adhesion surface of the plate-shaped core further has a second area overlapping with the fourth groove, the second area being exposed without being covered with the third surface of the flange.

12. The coil component as claimed claim 11, wherein the third groove is greater in width than the first groove.

13. The coil component as claimed claim 12 further comprising:
a fourth terminal electrode formed on the flange; and
a fourth wire wound around the winding core, wherein
the first surface further includes a seventh ridge and a fifth groove located between the fifth and seventh ridges,
the second surface further includes an eighth ridge and a sixth groove located between the sixth and eighth ridges,
the fourth terminal electrode extends over the seventh and eighth ridges,
the fourth wire is connected to the fourth terminal electrode on the seventh ridge,
the third groove is greater in width than the fifth groove, and
the adhesion surface of the plate-shaped core further has a third area overlapping with the sixth groove, the third area being exposed without being covered with the third surface of the flange.

14. The coil component as claimed claim 13, wherein the first and fifth groove is substantially the same as each other in width.

15. The coil component as claimed claim 8, wherein the first and second terminal electrodes are electrically connected to each other on the second surface.

16. The coil component as claimed in claim 8, wherein a width of the first terminal electrodes is substantially a same as a width of the first and third ridges, and a width of the second terminal electrodes is substantially a same as a width of the second and fourth ridges.

* * * * *